US007314385B2

(12) United States Patent
Tsukumo

(10) Patent No.: US 7,314,385 B2
(45) Date of Patent: Jan. 1, 2008

(54) ELECTRICAL CONNECTOR

(75) Inventor: Hidehiro Tsukumo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 272 days.

(21) Appl. No.: 11/226,394

(22) Filed: Sep. 15, 2005

(65) Prior Publication Data

US 2006/0087819 A1 Apr. 27, 2006

(30) Foreign Application Priority Data

Oct. 25, 2004 (JP) ..... 2004-309519

(51) Int. Cl.
*H01R 12/24* (2006.01)

(52) U.S. Cl. ..... 439/495; 439/260

(58) Field of Classification Search ..... 439/495, 439/492, 493, 260, 630, 67, 77
See application file for complete search history.

(56) References Cited

U.S. PATENT DOCUMENTS 5,356,308 A * 10/1994 Toba et al. ..... 439/495
5,470,246 A * 11/1995 Mosquera ..... 439/260
5,741,154 A * 4/1998 Fujikura et al. ..... 439/495
6,722,905 B2 * 4/2004 Negishi et al. ..... 439/260
2002/0094717 A1 * 7/2002 Sakai et al. ..... 439/495

* cited by examiner

*Primary Examiner*—Hien Vu
(74) *Attorney, Agent, or Firm*—Takeuchi & Kubotera, LLP

(57) ABSTRACT

A cover equipped electrical connector includes a housing (11) to be provided on a circuit board (P); a terminal (20) having a contact section (23) and a connection section (24) projecting from the housing (11) onto the circuit board (P); a pressure member (13) movable between an open position where a flat type cable is inserted into the housing (11) and a closed position where the pressure member (13) presses the flat type cable against the contact section (23); a cover member (30) movable between a stand-by position where the connection section (24) is exposed and a cover position where it covers the connection section (24); and a support member (36) for supporting the pressure member (13) and the cover member (30).

6 Claims, 10 Drawing Sheets

FIG. 10 (B) PRIOR ART
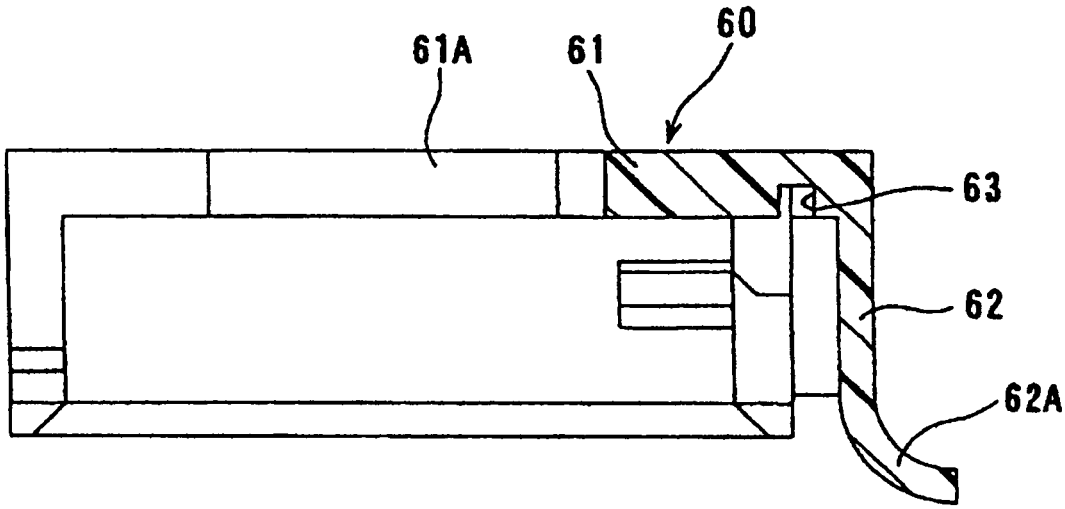
FIG. 10 (A) PRIOR ART
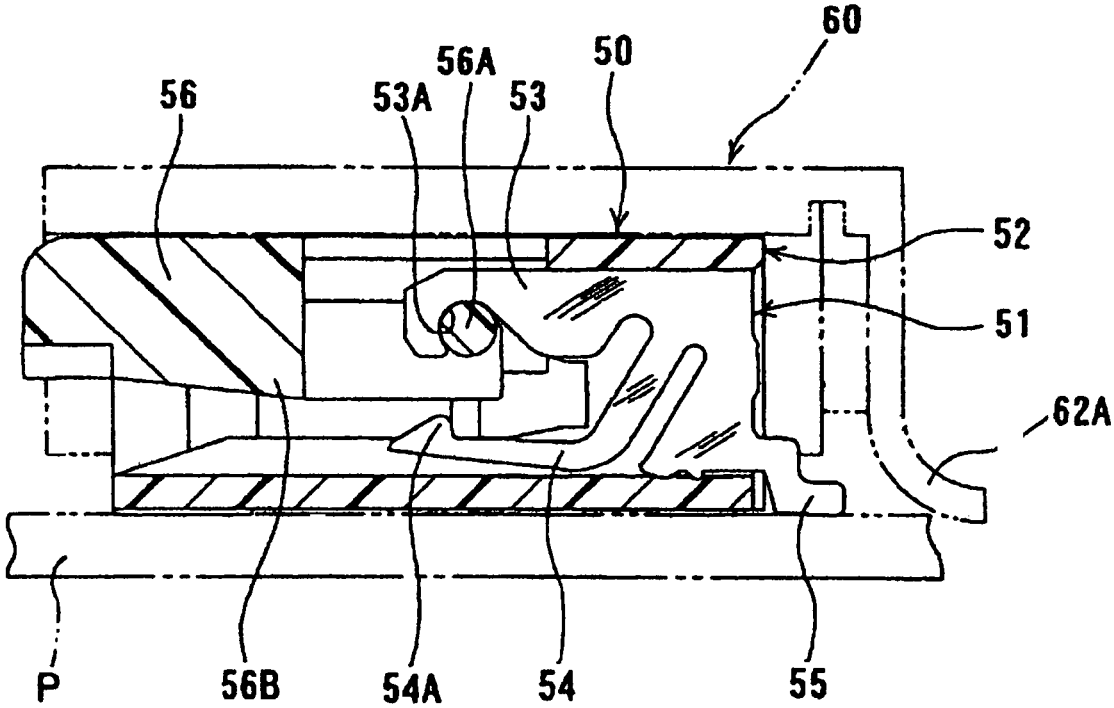

ELECTRICAL CONNECTOR

BACKGROUND OF THE INVENTION

1. Field of the Invention

The present invention relates to electrical connectors with a cover and, particularly, to an electrical connector that is to be mounted on a circuit board and has a cover member for covering the connection section of a terminal for protection from dust and dirt when it is connected to a circuit trace of the circuit board.

2. Description of the Related Art

FIG. 10(A) shows a conventional connector body 50 and FIG. 10(B) shows a conventional cover member 60.

The connector body 50 includes a housing 52 for supporting a terminal 51 formed by stamping a metal sheet. A plurality of terminals 51 are arranged at predetermined intervals in the third direction perpendicular to the paper sheet. The housing 52 has an upper left opening and a slit extending along the paper sheet in the right side half thereof for supporting the terminal 51. The terminal 51 includes an upper support arm 53, a lower resilient contact arm 54, and a connection leg 55 that projects from the lower right corner of the housing 52. The upper support arm 53 has a circular bearing section 53A and the contact arm 54 has an upwardly extending contact projection 54A. The connection leg 55 is positioned so as to come to contact with a circuit trace (not shown) of the circuit board P when the housing 52 is placed on the circuit board P.

A pressure member 56 is provided in the upper left opening of the housing 52. It has a shaft portion 56A that is rotatably supported by the bearing portion 53A of the terminal 51. It is rotatable clockwise from the closed position as shown to the upright open position where it defines a space to insert a flat type cable (not shown) over the contact section 54A of the terminal 51. It has a pressure section 56B to press the flat type cable against the contact section 54A at its closed position.

The cover member 60 is made so as to fit over the connector body 50. It has a cutout area 61A in an upper wall 61 thereof so as to allow the pressure member 56 to be rotatable to the closed position. Also, it has a groove 63 so that a right side wall 62 becomes flexible. The right side wall 62 has an outwardly curved lower lip portion 62A.

After the connector body 50 is placed on the circuit board P, the connection section 55 of the terminal 51 is soldered to the corresponding circuit trace. The pressure member 56 is brought into the open position and a flat type cable is inserted. Then, the pressure member 56 is rotated to the closed position so that the pressure section 56B presses the flat type cable against the contact section 54A of the terminal 51. Then, the cover member 60 is fitted over the connector body 50 so that the lip portion 62A comes to resilient contact with the circuit board to prevent the formation of a gap through which dust and dirt can enter, thus protecting the connection leg 55 from dust and dirt.

In the cover equipped electrical connector in FIGS. 10(A) and (B), however, the connector body and the cover member are provided separately, that is, the cover member is attached to the connector body after the connector is connected to the circuit board so that it is necessary to provide a separate cover member and a process step to attach it to the connector. In addition, the cover body can be lost in the process.

SUMMARY OF THE INVENTION

Accordingly, it is an object of the invention to provide a cover equipped electrical connector into which a cover member is incorporated so as to cover the connection section of a terminal at a time of connection of a cable after the terminal is connected to a circuit board.

According to the invention there is provided a cover equipped electrical connector which includes a housing to be provided on a circuit board and having an internal space; a terminal having a contact section provided in the internal space and a connection section projecting from the housing onto the circuit board; a pressure member movable between an open position where a flat type cable is inserted into the internal space and a closed position where the pressure member presses the flat type cable against the contact section; a cover member movable between a stand-by position where the connection section on the circuit board is exposed to a cover position where it covers the connection section; and a support member for supporting the pressure member and the cover member.

The connection section of a terminal soldered to the corresponding circuit trace is covered by the cover member at the cover position for protection.

The cover equipped electrical connector may further comprise an engaging member for engaging the pressure member and the cover member for simultaneous movement and releasing the pressure member from the cover member after the cover member reaches the cover position. When the pressure member is moved to the open position to prepare insertion of a flat type cable, the cover member is moved to the cover position where it covers the connection section for protection. When the pressure member is moved to the closed position, the cover member remains at the cover position. The pressure member may be moved to the open position by moving the cover member to the cover position.

The cover member may be moved from the stand-by position to the cover position as the pressure member is moved to the open position. It may be movable from the stand-by position to the cover position by at least one of rotary and linear movements. It may be provided with a lock member for locking the cover member at the cover position. It may be provided with a cam shaft and the housing or support member is provided with a cam bearing which has a flexible portion so that the cam shaft passes over a maximum flexed position of the flexible portion when the cover member is rotated to the cover position. The reverse rotation to the open position is prevented by the reactive force from the cam bearing section.

As described above, since the cover member is incorporated in the connector, no separate cover member is required, making it easy to assemble and manage the components. The movement of the pressure member to the open position is linked to the movement of the cover member to the cover position so that only by moving the pressure member to the open position for insertion of a flat type cable, it is possible to move the cover member to the cover position, making the operation simple.

BRIEF DESCRIPTION OF THE DRAWINGS

FIG. 10(A) is a sectional view of a conventional cover member; and

FIG. 10(B) is a sectional view of a conventional connector body, with the cover member shown in broken line.

DESCRIPTION OF THE PREFERRED EMBODIMENTS

Embodiments of the invention will now be described with respect to the accompanying drawings.

First Embodiment

Figure 1:
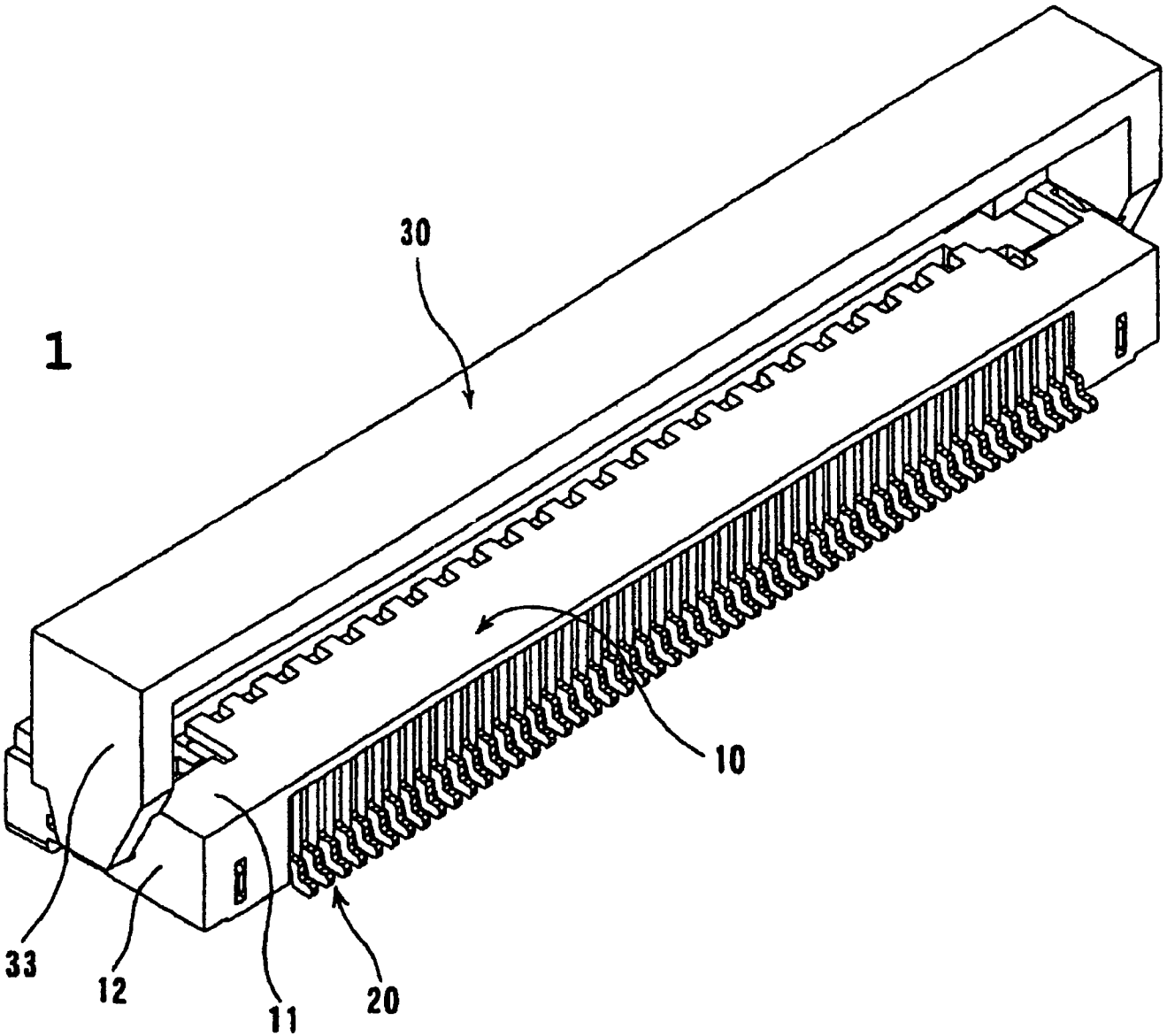
FIG. 1 is a perspective view of a cover equipped electrical connector according to the first embodiment of the invention.
Figure 2:
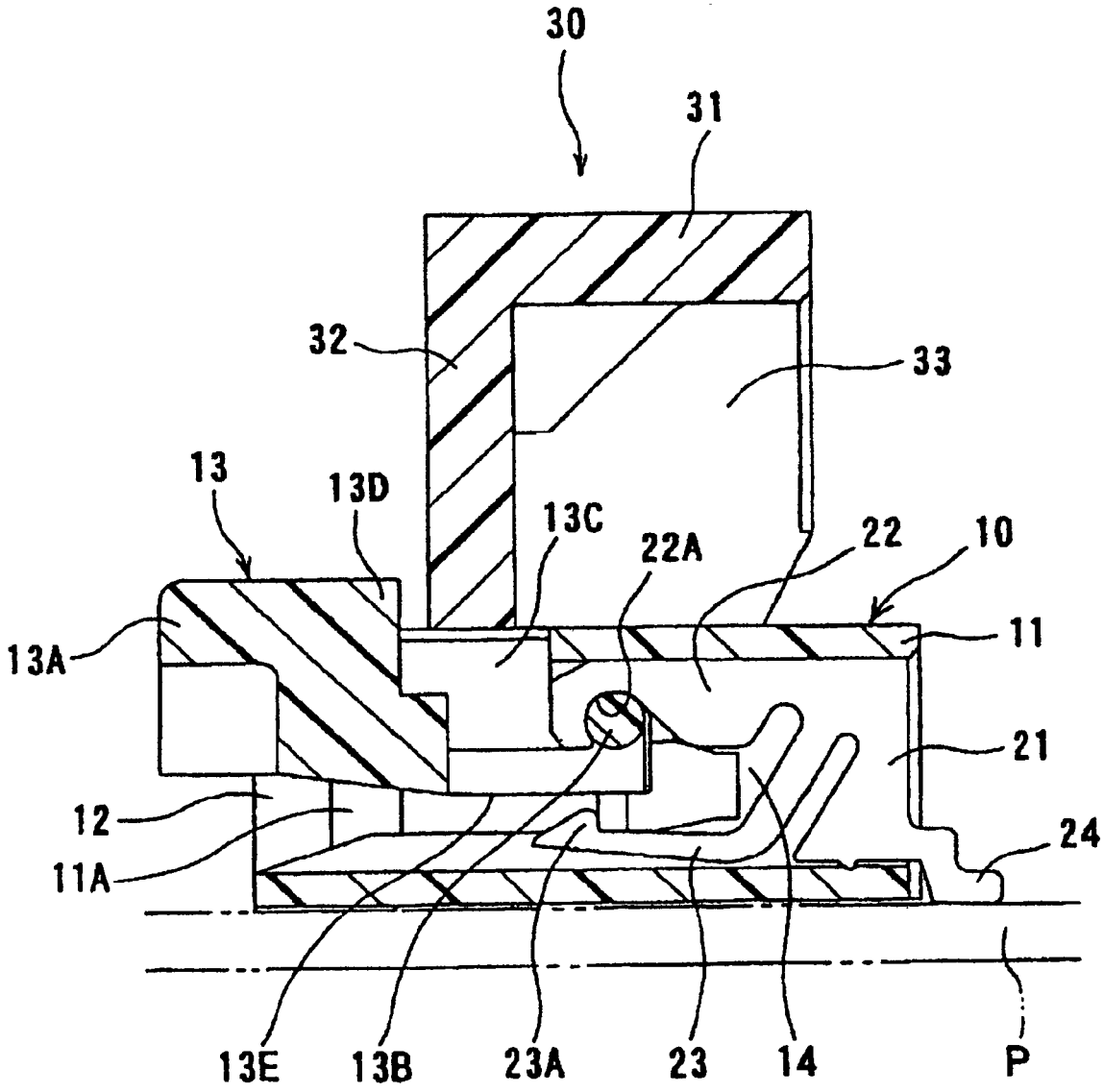
FIG. 2 is a cross section of the electrical connector of FIG. 1.

In FIG. 1, a connector includes a connector body 10 and a cover member 30. The body 10 has an elongated rectangular form along which a plurality of flat terminals 20 are arranged. It includes a housing 11 made of an insulative material in which the terminals 20 are arranged. As shown in FIG. 2, the housing 11 has a pair of end walls 12 to define an opening 11A between them into which a pressure member 13 is provided. It has a plurality of slits 14 extending along the paper sheet in the right half thereof into which the terminals 20 are press fitted. Each slit 14 communicates with the opening 11A on the left side.

The terminal 20 is made of a flat metal sheet and has a press fit section 21 press fitted against the upper and lower edges of the slit 14, a support arm 22 extending laterally from the press fit section 21, a contact arm 23 extending downwardly and laterally from the base portion of the contact arm 23, and a crank shaped connection section 24 extending laterally from the press fit section 21 to the outside of the housing 11. The support arm 22 has high rigidity and a bearing portion or circular recess 22A at the lower front end. The contact arm 23 is resilient and flexible and has a contact portion or upward projection 23A at the front end. The connection section 24 has a lower edge outside the housing 11 that is level with or slightly lower than the bottom face of the housing 11 so that when the housing 11 is placed on the circuit board, the lower edge of the connection section 24 comes to contact with the corresponding circuit trace of the circuit board without failure.

The pressure member 13 is made of an insulative material and has an operation section 13A that projects from the housing opening 11A and a shaft portion 13B that is rotatably supported by the bearing portion 22A of the terminal 20. It extends in the third direction in the range of the opening 11A. The opposite ends of the shaft portion 13B are rotatably supported by the housing 11. It has a cutout portion 13C so as to allow its 90-degree clockwise rotation from the closed position to the open position where the opening 11A of the housing 11 is opened widely. Also, it has a pressure portion 13D at the edge of the cutout portion 13C to press the cover member 30 at its open position and a pressure section 13E at its lower corner to press a flat type cable at its closed position.

Figure 3A:
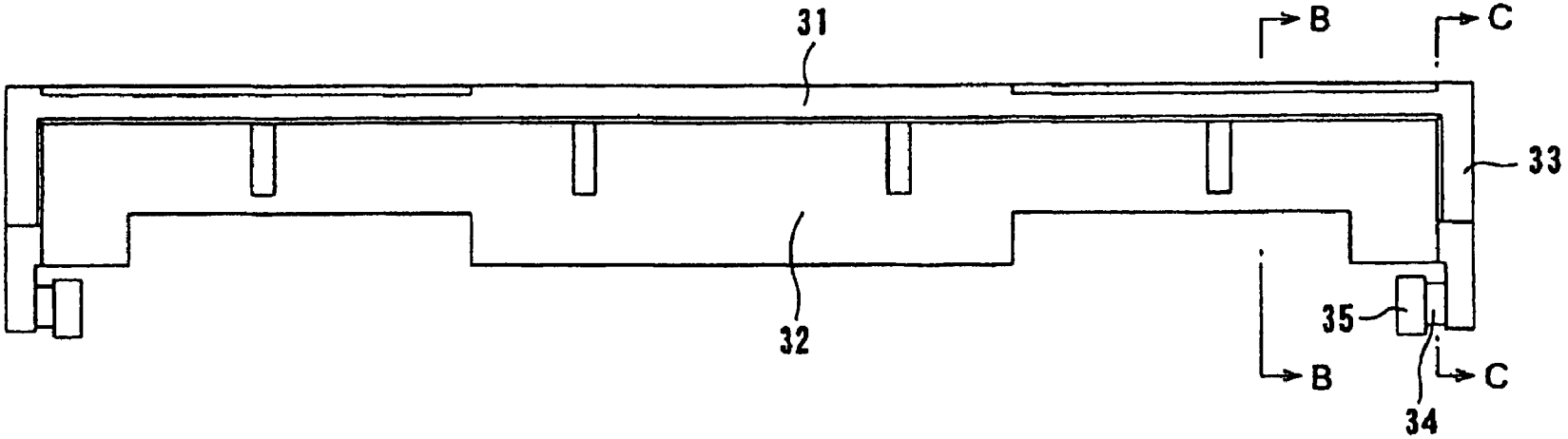
FIG. 3(A) is a front view of the cover member of FIG. 1.
Figure 3B:
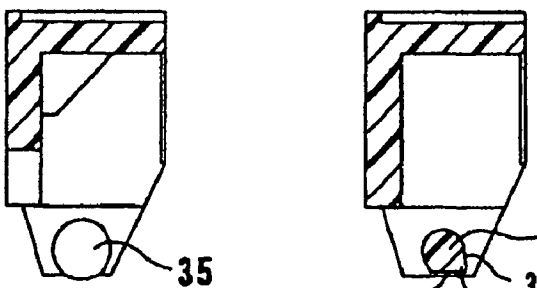
FIG. 3(B) is a sectional view taken along line B-B of FIG. 3(A)
Figure 3C:
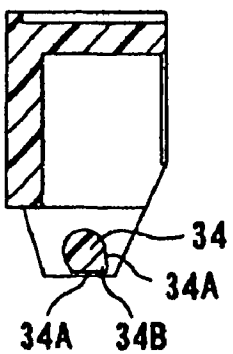
FIG. 3(C) is a sectional view taken along line C-C of FIG. 3(A)

The cover member 30 is made of an insulative material and has an upper wall 31 and a side wall 32 to form an inversed L-shaped cross section and extend in the third direction. As shown in FIG. 1, it also has a pair of end walls 33 outside the housing end walls 12, thus providing a space defined by the upper wall 31, the side wall 32, and the end walls 33. As shown in FIGS. 3(A), 3(B), and 3(C), each end wall 33 has inwardly extending cam shaft 34 and a rotation shaft 35 in the same axis. As shown in FIG. 3(C), the cam shaft 34 has, in cross section, a circular portion and an angled portion 34B made of two straight planes 34A where the cam radius becomes the largest.

The housing 11 supports the rotation shaft 35 and the cam shaft 34 of the cover body 30 at the end walls 12. FIG. 4(A) shows in cross section the connector body 10 and the cam shaft 34 of the cover member 30. FIG. 4(B) shows in cross section the rotation shaft 35 of the cover member 30. A support member 36 made by bending a metal sheet is attached to the housing 11. It has a cam support arm 36A and a fixing leg 36B, both of which are linked by a lower linking section 36C. The fixing leg 36B extends in parallel with and longer than the cam support arm 36A. It has a tapered front portion. The cam support arm 36A has an upper arm 36A1 and a lower arm 36A2. They extend in parallel to each other. The upper arm 36A1 is relatively wide and rigid while the lower arm 36A2 is narrower and flexible. The distance between the upper arm 36A1 and the lower arm 36A2 is substantially equal to the diameter of the circular portion of the cam shaft 34.

The fixing leg 36B of the support member 36 is press fitted into a corresponding slot (not shown) of the housing 11 in the direction of arrow A such that the cam support arm 36A comes into contact with the end wall 12 of the housing 11. The linking section 36C is soldered to a dummy pad of a circuit board to work as metal fittings. A U-shaped recess is provided in the end wall 12 of the housing 11 to support the rotation shaft 35 of the cover member 30. The support member 36 is attached by press fitting the fixing leg 36B into the corresponding slot of the housing 11 after the rotation shaft 35 of the cover member 30 is placed in the recess 12B as shown in FIG. 4(B), which supports the cam shaft 34 between the upper arm 36A and the lower arm 36B as shown in FIG. 4(A). The position of the cam shaft 34 as shown in FIG. 4(A) corresponds to the upright position of the cover member 30 as shown in FIGS. 1 and 2.

How to use the cover equipped electrical connector will be described below.

(1) In FIGS. 1 and 2, the pressure member 13 is at the closed position and the cover member 30 is the upright stand-by position. This cover position corresponds to that of FIG. 6(A). As shown in FIG. 2, the connector is placed on a predetermined position of a circuit board P and soldered the connection section 24 of the connector terminal 20 to the corresponding circuit trace of the circuit board P.

Figure 5:
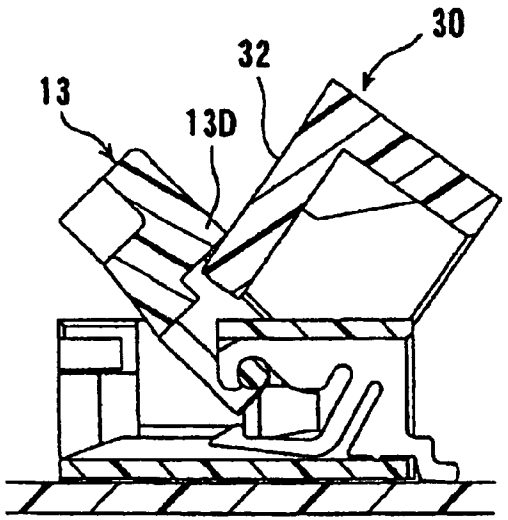
FIG. 5(A) is a sectional view of the electrical connector, with the pressure member moving to the open position.
FIG. 5(B) is a sectional view of the electrical connector, with the pressure member at the open position.
FIG. 5(C) is a sectional view of the electrical connector, with the pressure member returned to the closed position from the open position.
Figure 5:
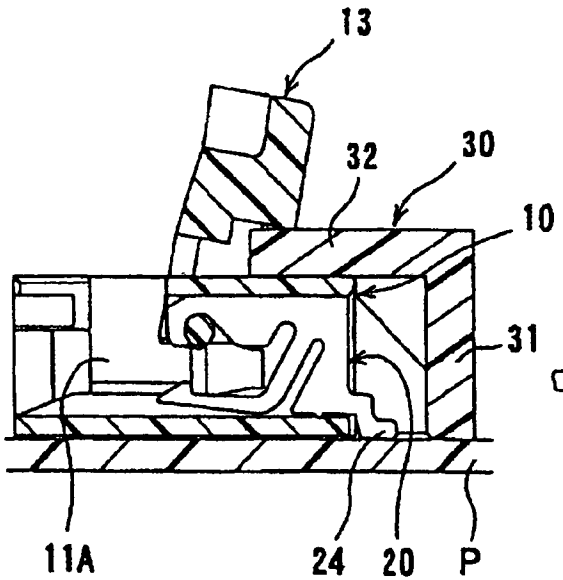
Figure 5:
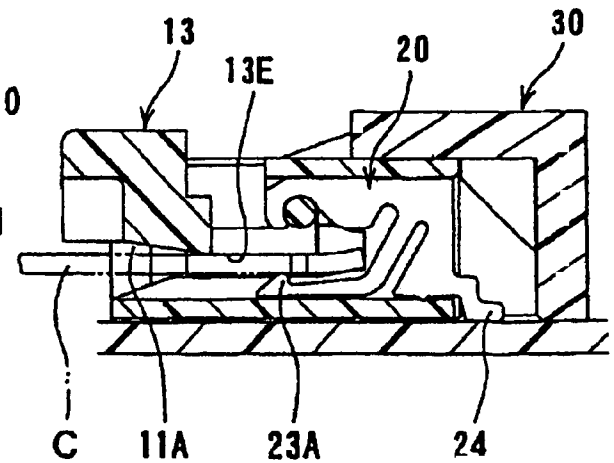
Figure 6:
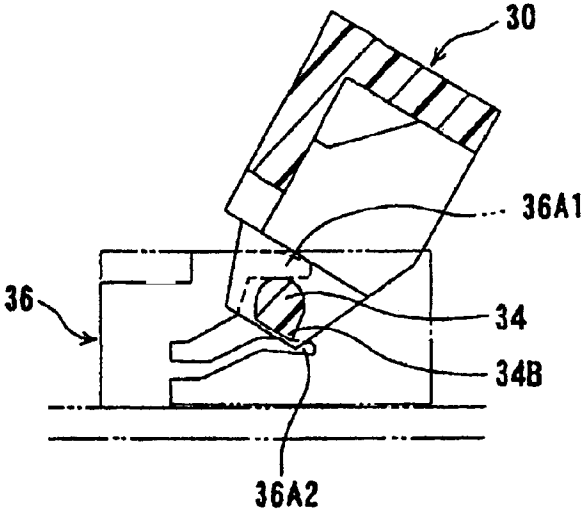
FIG. 6(A) is a sectional view of the cover member before the pressure member is moved to the open position.
FIGS. 6(B) and (C) are sectional views of the cover member being rotated to the cover position.
FIG. 6(D) is a sectional view of the cover member at the cover position.
Figure 6:
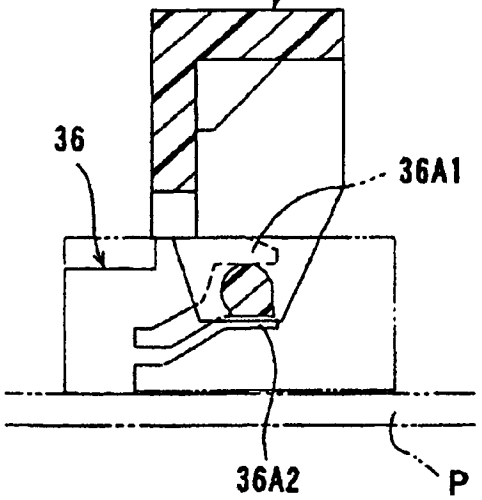
Figure 6:
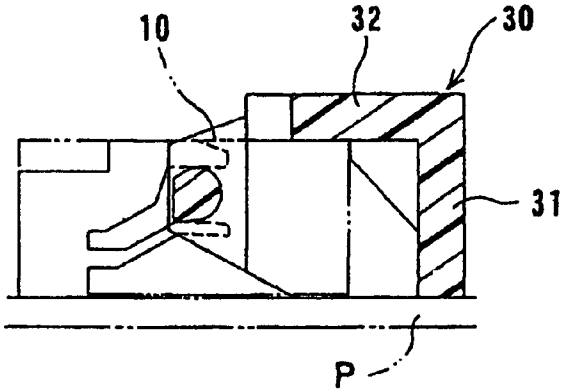
Figure 6:
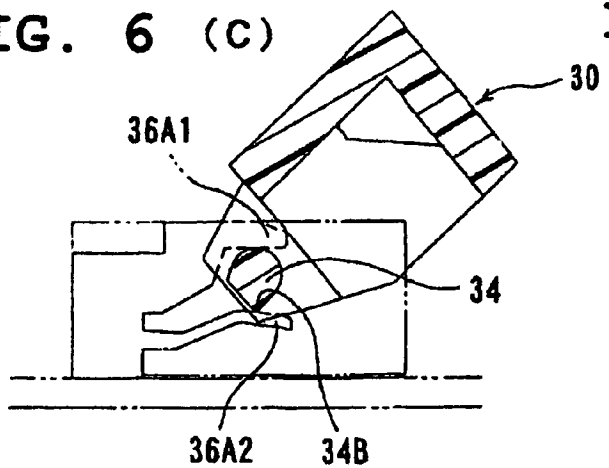

(2) The pressure member 13 is rotated clockwise to the open position to open the opening 11A of the connector body 10. As shown in FIG. 5(A), the pressure section 13D of the pressure member 13 pushes the side wall 32 of the cover member 30 to rotate the cover member 30 about the rotation shaft 35. As shown in FIGS. 6(A) and 6(B), the angled section 34B of the cam shaft 34 flexes downwardly the lower arm 36A2, increasing the distance between the upper arm 36A1 and the lower arm 36A2.

(3) Then, the cam shaft 34 passes over the maximum position where the distance between the upper arm 36A1 and the lower arm 36A2 becomes the largest as shown in FIG. 6(C). Then, as shown in FIGS. 5(B) and 6(D), the right end of the upper wall 31 of the cover member 30 abuts on the circuit board P, where the side wall 32 of the cover member 30 is brought closely to the upper face of the connector body 10 so that the cover member 30 covers the connection section 24 of the terminal 20 at its "cover position". At this point, the cam shaft 34 slightly increases the distance between the upper arm 36A1 and the lower arm 36A2 and the angled section 34B produces a clockwise torque so as to urge the upper wall 31 against the circuit board. The pressure member 13 is at the closed position so that the opening 11A of the connector body permits insertion of a flat type cable.

(4) Then, as shown in FIG. 5(C), the flat type cable C is inserted through the opening 11A and the pressure member 13 is rotated counterclockwise to the closed position while the cover member 30 remains at the cover position. The pressure section 13E of the pressure member 13 presses the flat type cable C against the contact section 23A of the terminal 20 for resilient contact. Thus, the cover member 30 is brought into the cover position to protect the connection section 24 in step with the operation of the pressure member 13.

It is preferred to provide a lock device between the cover member and the housing to secure the cover member 30 at the cover position. For example, as shown by broken line in FIG. 4(A), a lock projection 15 with an upper slope 15A is provided on the housing and a corresponding engaging shoulder is provided on cover member so that the engaging shoulder snaps on the lock projection at the cover position for making lock.

Second Embodiment

In the first embodiment, the pressure member abuts on the cover member during rotation to the open position and, if turned in the reverse direction in the middle of rotation to the open position, it is separated from the cover member. By contrast, the pressure member of the second embodiment is engaged with the cover member so that it will not be separated up to the closed position of the pressure member.

Figure 7:
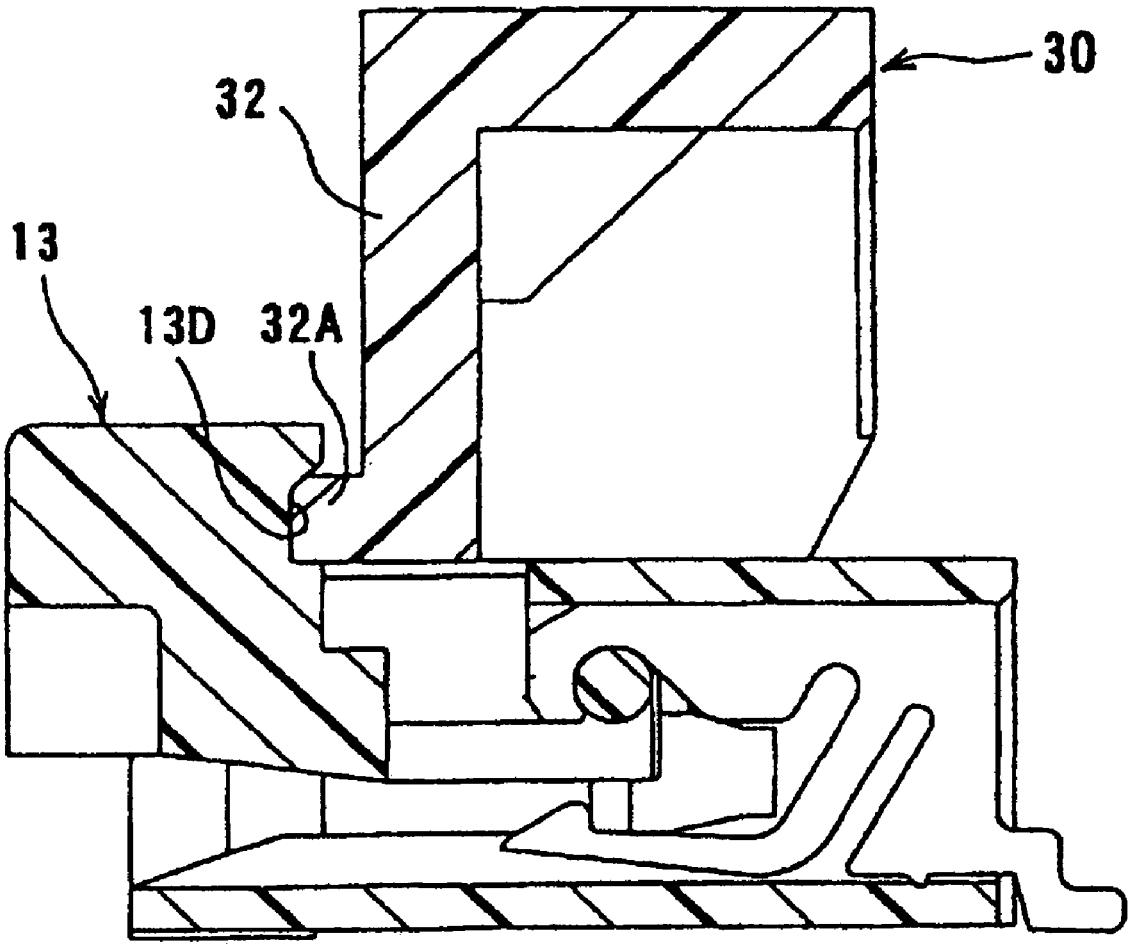
FIG. 7 is a sectional view of an electrical connector according to the second embodiment of the invention before the pressure member is rotated to the open position.

In FIG. 7, a pressure member 13 has a pressure section or tapered recess 13D and a cover member 30 has a lower projection 32A for fitting in the pressure section 13D. The other features of the second embodiment are the same as those of the first embodiment.

Figure 4:
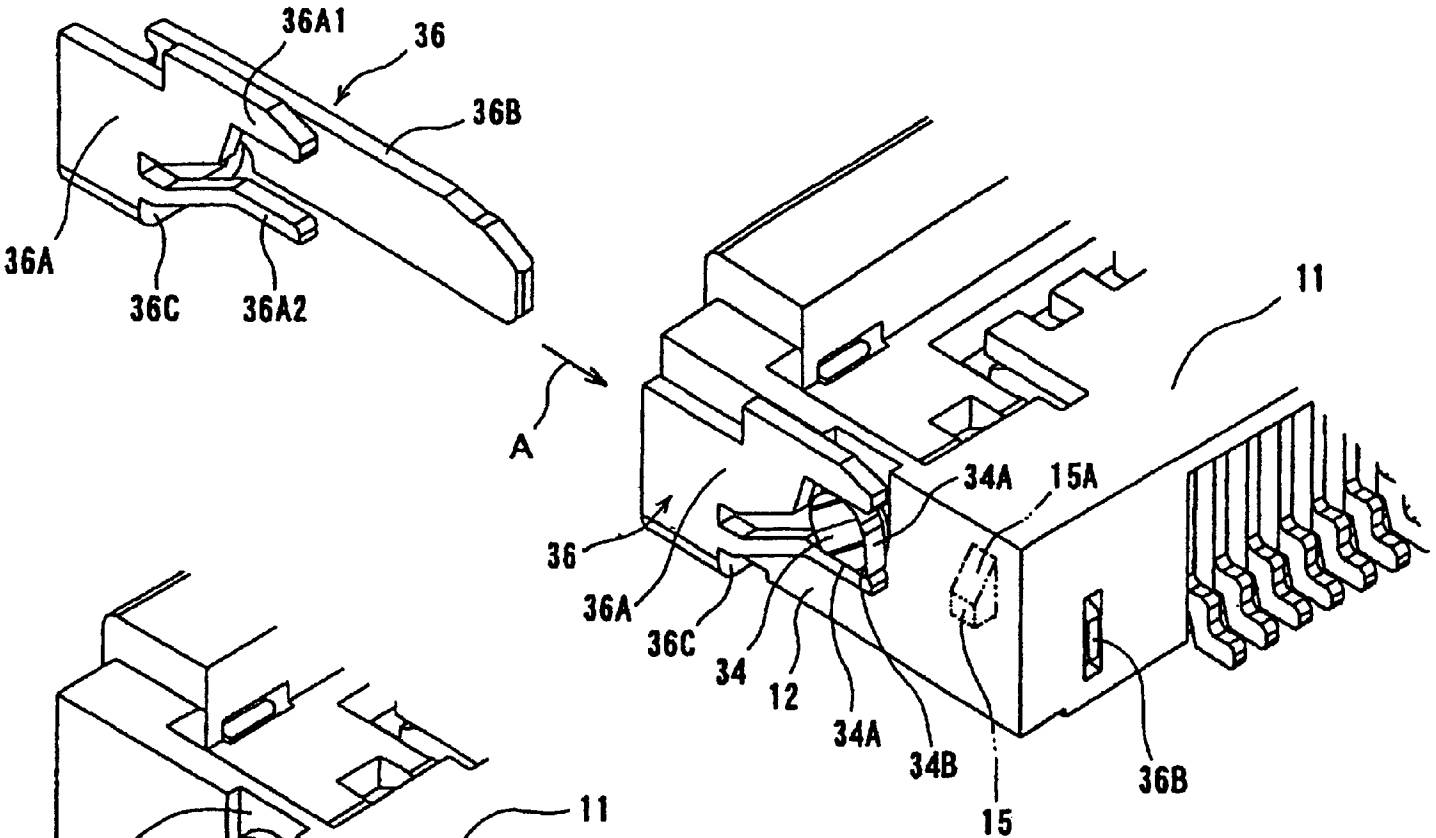
FIG. 4(A) is a perspective view of a side portion of the connector housing of FIG. 1 cut at the cam shaft.
FIG. 4(B) is a perspective view of the side portion of the connector housing cut at the rotation shaft.
Figure 4:
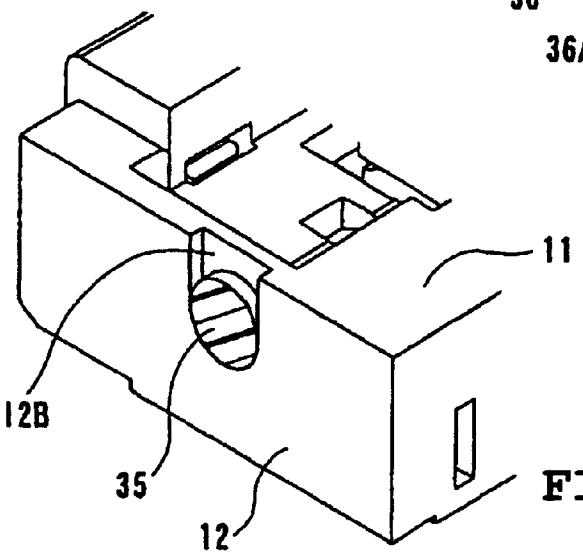
Figure 8:
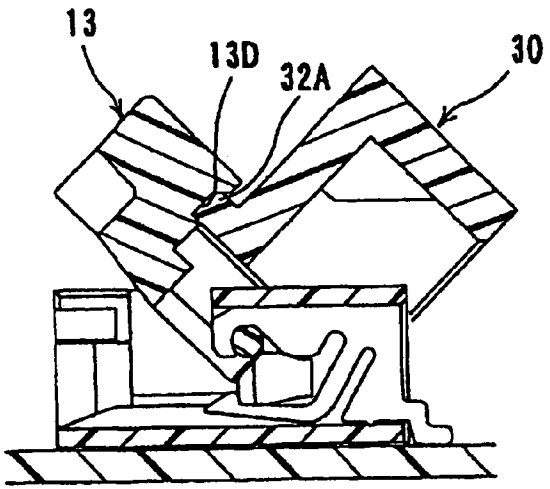
FIG. 8(A) is a sectional view of the electrical connector of FIG. 7 as the pressure member is rotated to the open position.
FIG. 8(B) is a sectional view of the electrical connector of FIG. 7 when the pressure member is at the open position.
FIG. 8(C) is a sectional view of the electrical connector of FIG. 7 when the pressure member is returned to the closed position from the open position.
Figure 8:
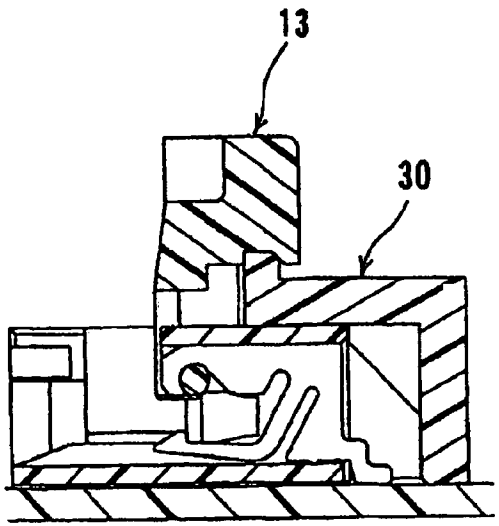
Figure 8:
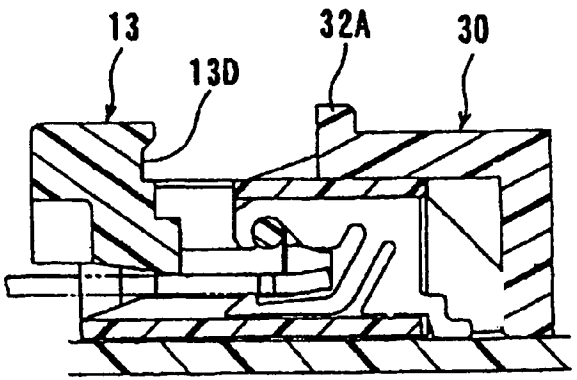

As shown in FIGS. 8(A) and 8(B), the pressure member 13 and the cover member 30 are united by the pressure section 13D and the projection 32A for simultaneous rotation to the open position. This simultaneous rotation is carried out by rotating either the pressure member 13 or the cover member 30. When the pressure member 13 reaches the open position, the cover member 30 is locked at the cover position by the lock device as shown in FIG. 4. The locking force is made greater than the release force of engagement between the pressure section 13D and the projection 32A so that only the pressure member 13 is returned to the closed position. See FIG. 8(C).

Third Embodiment

In the first and second embodiments, the cover member is rotated to the cover position as the pressure member is rotated to the open position but, in this embodiment, the cover member is moved linearly with slight rotation.

Figure 9A:
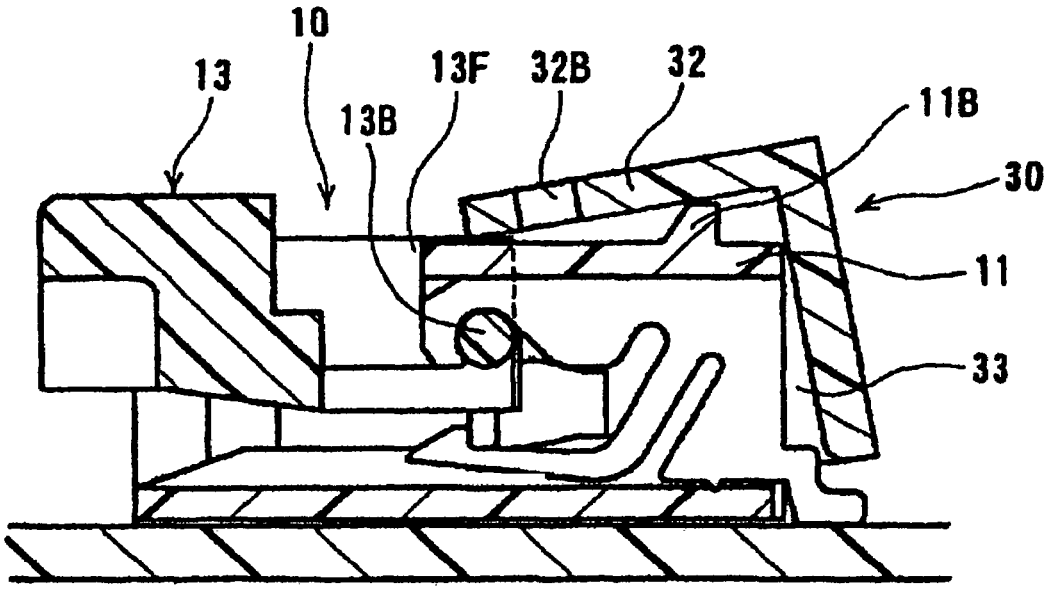
FIG. 9(A) is a sectional view of an electrical connector according to the third embodiment of the invention before the pressure member is rotated to the open position.

In FIG. 9(A), a lock projection 11B is provided on the upper face of a housing 11 of a connector body 10. A lock hole 32B is provided in a side wall 32 of a cover member 30 to fit over the lock projection 11B when the cover member 30 reaches the cover position. The cover member 30 is biased downwardly by a later described biasing or support member.

Figure 9B:
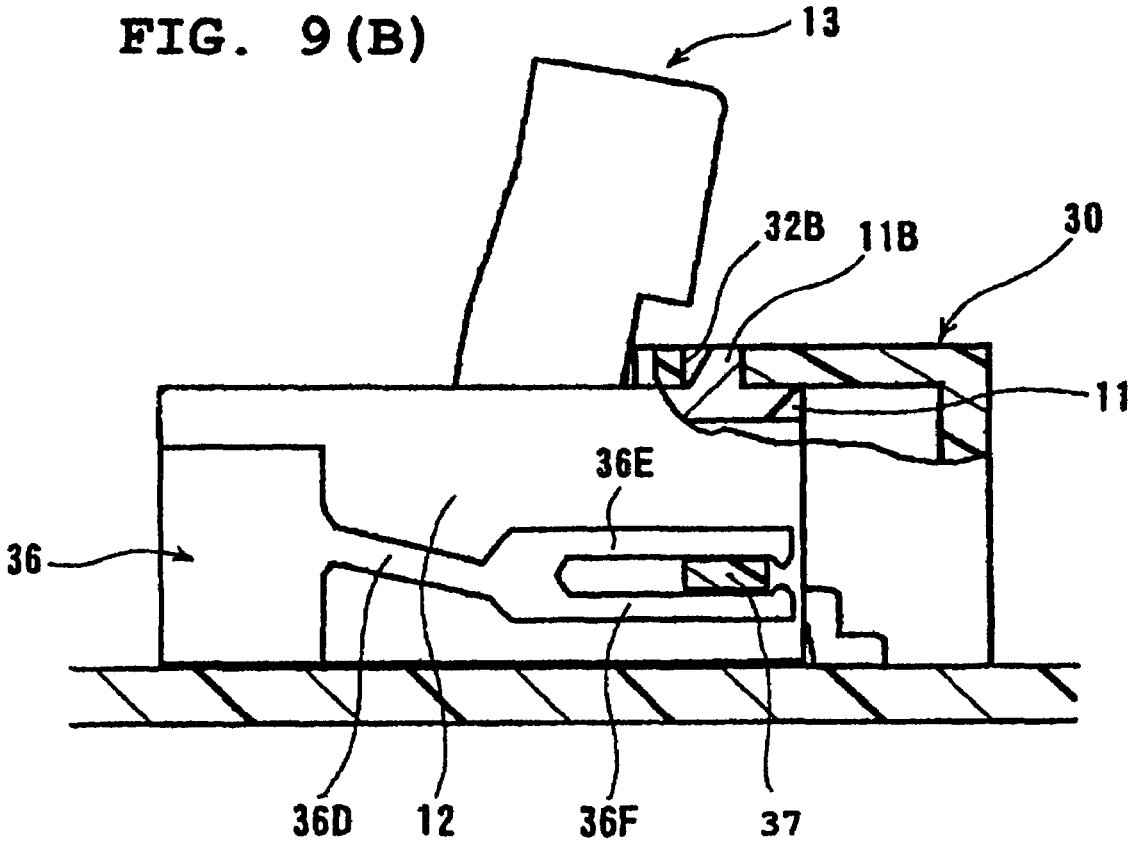
FIG. 9(B) is a side view, partially in section, of the electrical connector of FIG. 9(A) when the pressure member reaches the open position.

In FIG. 9(B), a support member 36 made of a metal sheet is attached to the outside of an end wall 12 of the housing 11. It has a flexible arm 36D which has an upper arm 36E and a lower arm 36F. A rectangular projection 37 is provided on the inside of an end wall 33 of the cover member 30. It is supported between the upper arm 36E and the lower arm 36F for lateral sliding movement and biased downwardly. As shown in FIG. 9(A), the pressure member 13 is rotatable until its front portion 13F meshes with the upper wall of the housing 11 like a comb.

When the pressure member 13 rotates from the closed position of FIG. 9(A) to the open position of FIG. 9(B), it pushes the cover member 30 to the right. When the lock hole 32B of the cover member 30 reaches the lock projection 11B of the housing 11, the cover member 30 is pulled downwardly by the biasing member to the cover position, with the lock hole 32B fitting over the lock projection 11B to lock the cover member 30 in place.

The invention claimed is:

1. A cover equipped electrical connector, comprising:

a housing having end walls to be positioned on a circuit board and having an internal space;

a terminal having a contact section provided in said internal space and a connection section projecting from said housing onto said circuit board;

a pressure member rotatably movable in directions between an open position where a flat type cable is inserted into said internal space and a closed position where said pressure member presses said flat type cable against said contact section;

a cover member rotatably movable in different directions with the directions of the pressure member between a stand-by position where said connection section on said circuit board is exposed and a cover position where it covers said connection section; and support means attached to one of the end walls and having a support arm for supporting said pressure member and said cover member.

2. The cover equipped electrical connector according to claim 1, which further comprises interlocking means for interlocking said pressure member and said cover member for interlocked movement and releasing said pressure member from said cover member after the cover member reaches said cover position.

3. The cover equipped electrical connector according to claim 2, wherein said cover member is moved from said stand-by position to said cover position as said pressure member is moved to said open position.

4. The cover equipped electrical connector according to claim 2, wherein said cover member is movable from said stand-by position and said cover position in at least one of rotary and linear movements.

5. The cover equipped electrical connector according to claim 1, wherein said cover member is provided with lock means for locking said cover member at said cover position.

6. The cover equipped electrical connector according to claim 4, wherein said cover member is provided with a cam shaft and said housing or support means is provided with a cam bearing which has a flexible portion so that said cam shaft passes over a maximum flexed position of said flexible portion when said cover member is rotated to said cover position.

* * * * *